United States Patent [19]

Cook

[11] Patent Number: 4,601,277

[45] Date of Patent: Jul. 22, 1986

[54] SYSTEM FOR COMBINED EGR AND IDLE SPEED CONTROL

[75] Inventor: John E. Cook, Chatham, Canada

[73] Assignee: Canadian Fram Limited, Chatham, Canada

[21] Appl. No.: 624,162

[22] Filed: Jun. 25, 1984

[51] Int. Cl.[4] ..... F02M 25/06

[52] U.S. Cl. ..... 123/571; 123/587

[58] Field of Search ..... 123/339, 568, 569, 571, 123/585, 586, 587

[56] References Cited

U.S. PATENT DOCUMENTS

| | | | |
|---|---|---|---|
| 4,116,178 | 9/1978 | Saito | 123/571 X |
| 4,117,814 | 10/1978 | Takahashi | 123/587 X |
| 4,122,812 | 10/1978 | Takano | 123/571 |
| 4,168,681 | 9/1979 | Kawai et al. | 123/339 X |
| 4,313,415 | 2/1982 | Shinzawa | 123/571 X |
| 4,321,900 | 3/1982 | Takeda | 123/585 X |

FOREIGN PATENT DOCUMENTS

| | | | |
|---|---|---|---|
| 0117058 | 9/1980 | Japan | 123/587 |

*Primary Examiner*—Willis R. Wolfe, Jr.

*Attorney, Agent, or Firm*—Markell Seitzman; Russel C. Wells

[57] ABSTRACT

A system including a throttle body communicating intake air to the intake manifold of an engine, the throttle body including a movable throttle plate. A vacuum responsive idle speed bypass valve is used to bypass intake air around the throttle plate and into the intake manifold, a vacuum responsive EGR valve is used for regulating the amount of exhaust gas permitted to be recirculated into the intake manifold, a single electric vacuum regulating (EVR) communicated to a vacuum inport port, the idle speed bypass valve and EGR valve to be employed to vary the degree of manifold vacuum communicated thereto.

11 Claims, 5 Drawing Figures

SYSTEM FOR COMBINED EGR AND IDLE SPEED CONTROL

BACKGROUND AND SUMMARY OF THE INVENTION

This invention relates generally to the utilization of a single electrically responsive vacuum regulating device to control a plurality of air control devices and, more specifically, to a system which utilizes an electric vacuum regulator to control the degree of vacuum supplied to an exhaust gas recirculation (EGR) valve and to an idle speed bypass valve.

Modern automobile engines must usually be maintained at sufficiently low engine speeds in order to lessen the amount of pollutants given off by the engine while it is idling. The idle speed bypass valve (idle air bypass valve or bypass valve) is utilized to set the engine idle speed as a function of the load on the engine. As is known, when vehicle accessories are switched on with the engine in an idling condition, the engine may stall. An example of idle speed bypass valves is illustrated in U.S. Pat. No. 4,388,856 which illustrates a pneumatic device which controls the positioning of a plunger which in turn is used to vary the position of the throttle mechanism to readjust the engine idle speed as a function of engine load.

In order to reduce exhaust gas emissions when the engine is off-idle, an exhaust gas recirculation valve has typically been used to recirculate a determinable percentage of the exhaust gas within an exhaust system of the engine into the intake manifold.

The controlling of engine idle speed and EGR recirculation conventionally utilized two separate and independent mechanisms to control these separate and independent functions. A modification of these earlier systems is shown by Yamaguchi in U.S. Pat. No. 4,281,631 which uses a single solenoid valve but still requires an electrically responsive changeover valve.

It is an object of the present invention to provide a system employing a single vacuum regulating device to selectively control the vacuum applied to a plurality of air control devices.

A further object of the present invention is to utilize a single vacuum regulating device to control the operation of an exhaust gas recirculation (EGR) valve and an idle speed bypass valve.

It is a further object of the present invention to provide a system for combined control of the above-identified valves which exhibits simple construction and efficient operation.

Accordingly, the invention comprises:

In a system including a throttle body communicating intake air to the intake manifold of an internal combustion engine, the throttle body housing a movable throttle plate, a vacuum responsive idle air bypass valve for bypassing intake air around the throttle plate and into the intake manifold, a vacuum responsive EGR valve for regulating the amount of exhaust gas permitted to be recirculated into the intake manifold, the improvement comprising means responsive to the position of the throttle plate for communicating vacuum manifold pressure to one of either of the EGR valve or the idle air bypass valve and for communicating atmospheric pressure to the other EGR valve or idle air bypass valve; means communicated to a vacuum input port on each of idle air bypass valve and EGR valve for varying the degree of manifold vacuum communicated thereto.

DETAILED DESCRIPTION OF THE DRAWINGS

Figure 1:
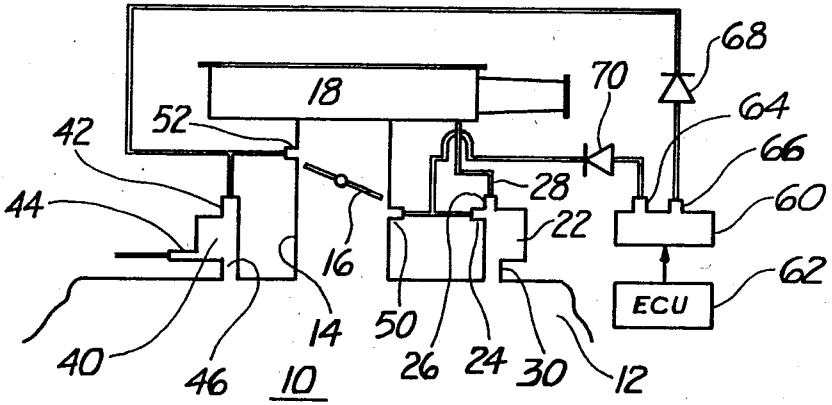
FIG. 1 illustrates a schematic view of the present invention.

With reference to FIG. 1 there is illustrated the major components of the present invention. There is illustrated an engine 10 having an intake manifold 12. A throttle body 14 of known construction is communicated with the intake manifold. The throttle body 14 includes a throttle plate 16 pivotably movable therein. The throttle linkage used to move the throttle plate is not shown. Seated upon the throttle body is an air cleaner 18. A fuel injector may be positioned above the throttle plate or associated with each cylinder. The injector is not shown. The invention further includes an idle air bypass valve (idle speed bypass valve) 22 which includes a first vacuum input or inlet port 24, an air inlet port 26 which is communicated via a tube 28 to the air cleaner 18 and an exhaust port 30 which is communicated to the input manifold 12. While the air inlet port 26 is illustrated as communicating with the air cleaner 18, it should be appreciated it can communicate with any point in the system upstream of the throttle plate 16.

The system further includes an exhaust gas recirculation valve, generally shown as 40, having a vacuum input port 42 and an exhaust gas input port 44 adapted to communicate in a known manner with the exhaust system of the engine and further includes an exhaust port 46 adapted to supply exhaust gas to the intake manifold 12 of the engine 10.

The throttle body 14 is modified to define a first and second pressure port 50 and 52 which are communicated respectively to the input port 24 and 42 of the idle speed bypass valve 22 and the EGR valve 40, respectively. An electric vacuum regulator, generally shown as 60, responsive to control signals generated by an ECU 62 comprises pressure ports 64 and 66 which are respectively communicated to the input ports 24 and 42 through check valves 68 and 70.

While the preferred embodiment of the invention illustrates the use of an EGR valve and an idle speed bypass valve, it should be understood that the invention is equally applicable to any type of pneumatic valves.

Figure 2:
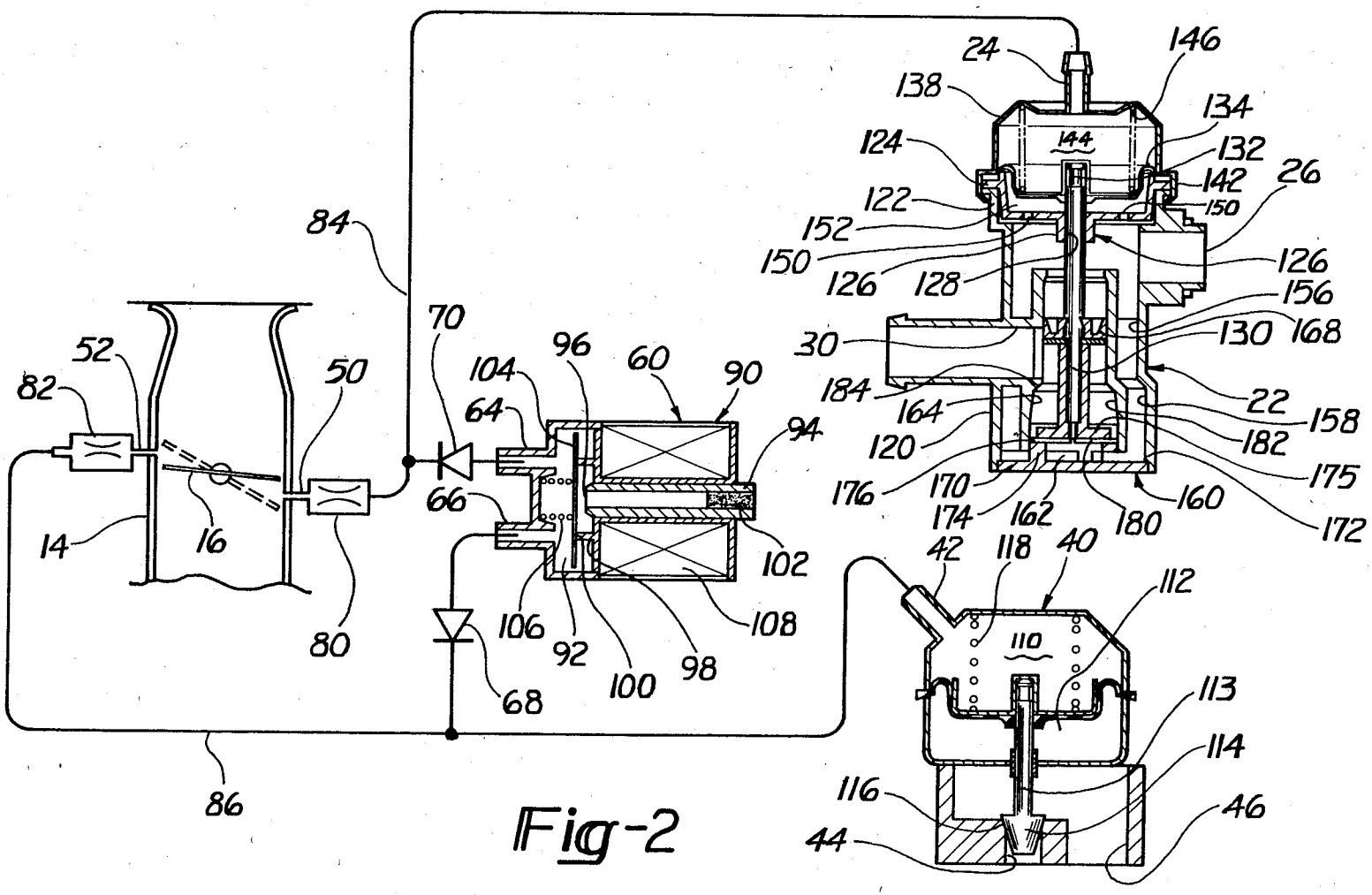
FIG. 2 illustrates a more detailed embodiment of the invention.

With reference to FIG. 2 there is illustrated a more specific embodiment of the invention. The major components of the system, such as the throttle body EGR valve, etc., are denominated by the same numerals illustrated in FIG. 1. As can be seen the throttle body 14 includes the first and second ports 50 and 52 positioned relative to the throttle plate 16 such that when the throttle plate 16 is in the position shown by the solid lines, the port 50 is exposed to manifold vacuum while port 52 is exposed to atmospheric pressure. Further, once the throttle plate 16 is rotated from the idle position as generally indicated by the dotted lines, the pressures exposed to the ports 50 and 52 are reversed. More particularly, in this off-idle condition, the port 50 is communicated to atmospheric pressure while port 52 is communicated with manifold vacuum pressure.

The system further includes a plurality of flow restrictors 80 and 82. The flow restrictor 80 is communicated via a pressure tube 84 to the vacuum inlet port 24 of the idle speed bypass valve 22 and the flow restrictor 82 is communicated via the pressure tube 86 to the vacuum inlet port 42 of the EGR valve 40.

The electric vacuum regulator valve 60 comprises a housing 90 defining a pressure chamber 92. The housing includes a plurality of pressure ports 64 and 66 each of which communicate to a pneumatic check valve 68 and 70 respectively. The housing 90 further defines a vent port 94 having an inner end 96 extending into the pressure chamber 92. A valve seat 98 defines a seating surface 100 which circumscribes the end 96 of the vent port 94. The other end of the vent port 94 may be fitted with filter material 102. Positioned within the pressure chamber 92 is a magnetically responsive movable plate 104 that is biased onto the seating surface 100 by a spring 106. The spring 106 is chosen to yield a threshold value in the operation of EVR 60 to approximately 20 millimeters of Hg. A coil of wire 108 is circumferentially positioned within the housing 90 about the vent port 94 and generates a magnetic force which urges the magnetic plate 104 onto the seating surface 100 in response to control signals received from the ECU 62 as illustrated in FIG. 1.

The EGR valve 40, as illustrated in FIG. 2, may be of known construction defining a pressure chamber 110 communicated to the vacuum input port 42. A flexible diaphragm 112 separates the pressure chamber 110 from the barometric pressure exerted on the lower surface of the flexible diaphragm. The flexible diaphragm 112 is biased by spring 118 to urge a valve, such as a tapered pintle valve, 114 into engagement with the valve seat 116. The bias force exerted by the spring 118 upon diaphragm 112 may be chosen to yield a threshold pressure level of approximately 35 millimeters Hg. A pin 130 is seated within and carried by the diaphragm 112. The piston moves the tapered pintle valve 114 relative to a valve seat 116 to permit the requisite flow of exhaust gases from port 44 through port 46 and into the intake manifold.

Figure 4:
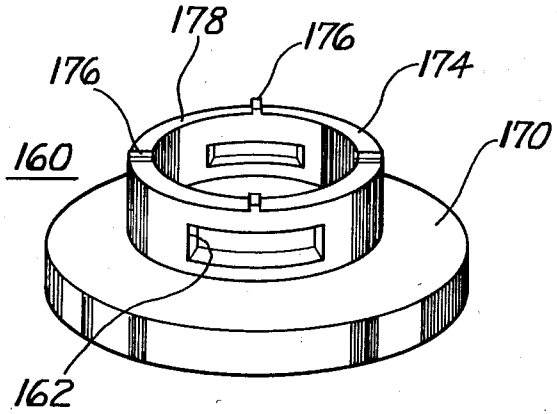
FIG. 4 shows an end cap for use with the invention.

The idle speed bypass valve 22 comprises a housing 120 defining the air inlet port 26 and an exhaust port 30. As previously mentioned the air inlet port 26 is adapted to communicate with the inlet air flow and, more particularly, may be adapted to receive air at a point upstream of the throttle plate 16. The exhaust port 30 is communicated in a known manner to the intake manifold of the engine. The end 122 of the housing is adapted to receive a centering member 124 having a central boss 126 defining a passage 128 through which a pin 130 is movable therethrough. The upper end 132 of the pin is received within a flexible diaphragm 134. A cover 138 having an end 142 engages the housing end 122 retaining member 124 and diaphragm 134 in a manner as to secure these above-noted members together. The cover 138 forms a variable volume pressure chamber 144 with the diaphragm 134 as its lower extreme as viewed in FIG. 2. A spring 146 is used to bias the diaphragm 134 and pin 130 downwardly. The cover 138 further includes a protruding member which forms the vacuum input port 24. The centering member 124 further includes a plurality of openings 150 for communicating atmospheric pressure into the space 152 between the diaphragm and the centering member 124. The housing further includes a plurality of passages 156, 158 and 162 used to communicate air from the air inlet port 26 to the exhaust port 30. More particularly the housing includes an axially positioned passage 156 which terminates at a circumferentially positioned passage 158 proximate an end cap 160 of the housing. The housing 22 and/or end cap 160 include a plurality of passages 162 for communicating the air within the circumferential passage 158 to a bore 164 through which the pin 130 moves. The end cap (160) is more clearly shown in FIG. 4. To insure the alignment of the pin 130 to the bore 164, a positioning member and seal 168 is lodged within the upper portion of the bore 164. With reference to FIG. 4 there is shown an orthogonal view of the end cap 160. The end cap is formed by a solid bottom member 170 which seats upon a circumferential shoulder 172 formed at the lower extreme of the end 172 of the housing 120. Centrally positioned on the bottom member 170 is an annular member 174 which has formed therein the passages 162. A plurality of bosses or standoffs 176 which comprise a portion of upraised material is formed on the upper edge 178 of the annular member 174.

With no vacuum applied to the input port 24 of valve 22, the pin 130 will be moved to its extreme downward condition. This condition of no vacuum might also exist if a malfunction occurred in the operation of the EGR valve. As will be seen from the discussion below, the system incorporates a fail-safe mode of operation which would permit continued operation of the idle air bypass valve 22 during the malfunction of the EGR valve 40. In this downward position the flanged end 175 of the pin rests upon the upraised members 176. In this position air flows from passage 158 through passages 162 into the lower end of bore 164 through the passage formed between the upper surface 178 of the annular member 174 and the lower surface of the valve formed on the end of pin 130. Since the flanged end 175 of the pin 130 is loosely received within bore 164, air flows from passage 180 into the upper extremes of bore 164 and out of the valve 22 through the exhaust port 30. These upraised members 176 serve as a stop to limit the maximum downward extension of the pin 130.

It is preferable the bore 164 be tapered such that the quantity of air flowing through the valve 22 may be varied as a function of the stroke of the piston 130 which in turn corresponds to the degree of vacuum communicated to the input port 24. This is accomplished by tapering the walls 182 of the lower portion of the bore 164. Air flow can be terminated by raising the pin 130 to bring its end 175 into contact with the walls 184 which serve as a seat thus prohibiting air flow from the input port 26 to the exhaust port 30.

Figure 3:
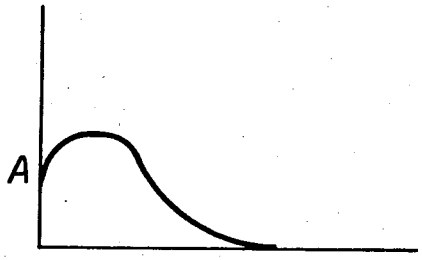
FIG. 3 shows the air flow through an idle speed bypass valve as a function of plunger movement.

The air flow through the valve 22 is defined by the spacing between the end 175 of the pin 130 and the walls 182 of the bore 164. Reference is made to FIG. 3 which illustrates the air flow as a function of increasing displacement of the piston from its downward position. Reference is briefly made to point A of FIG. 3 which corresponds to the condition of maximum downward deflection of the piston which in turn correlates to a condition wherein no manifold vacuum is applied to the input port 24. To achieve the fail-safe mode of operation mentioned above requires a nominal flow to be established for this condition. As can be seen in FIGS. 2 and 4, the air flow A is determined by the passage 180 which is defined by the axial clearance between the end 175 of the pin 130 and the annular member 174. As the pin 130 moves upwardly the air flow is defined, not by the dimensions of passage 180, but by the clearance between the end 175 of the pin and the tapered walls 182 of the bore 164. The taper of the walls 182 and the dimension of the end 175 of the pin cooperate to yield a rapid increase in flow area as the pin 130 moves upwardly. The flow diminishes as the piston approaches its seat 184 formed in the upper portion of the bore 164.

Figure 5:
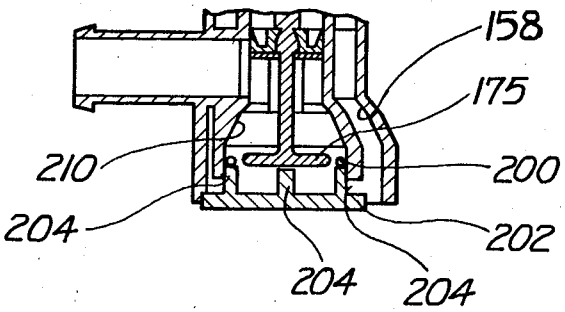
FIG. 5 shows an alternate embodiment of the invention.

Reference is now made to an alternate embodiment of the invention which is illustrated in FIG. 5. In this embodiment of the invention the nominal air flow at maximum extension of the piston is determined by the radial clearance of the end 175 of the pin with a ring 200. More specifically, the alternate embodiment of the invention utilizes an end cap 202 which includes an upraised member(s) 204 extending therefrom. This upraised member may include the annular member 174 having passages 162 as previously disclosed. The ring 200 is lodged upon the top of the members 204. In its downward condition the pin 130 seats upon the top of the member(s) 204. The fail-safe nominal air flow condition is now defined by the radial clearance between the end 174 of the pin and the ring 200. Of course as the pin 130 is moved upwardly the air flow is controlled by the clearance between the end 175 of the pin and the tapered walls 210 defining the passage through which the valve end 175 of pin 130 moves.

In operation with the vehicle at idle the throttle plate 16 is similarly moved to its idle condition which communicates manifold vacuum to the idle air bypass valve 22 through the flow restrictor 80 and port 50. In this idle condition of the throttle plate barometric or atmospheric pressure is communicated to the EGR valve through the flow restrictor 82 and port 52. With atmospheric pressure communicated to the pressure chamber 110 of the EGR valve 40, a pressure equilibrium is established across the diaphragm 112 which urges the pintle valve 114 against its seat 116 and thus removes the EGR valve from the system during idle. With manifold pressure similarly applied to a downstream side of check valve 70, the pressure within the pressure chamber 92 of the EVR valve 60 will tend to move toward the manifold vacuum pressure if the plate 104 is moved onto its seating surface 100. However, with no electric signals applied to the EVR 60, the pressure differential created across the plate 104 tends to move the plate off of its seating surface 100 therefore bleeding or reducing the vacuum pressure communicated to the idle air bypass valve 22. However, in response to the variable duty cycle input signal communicated to the EVR valve 60 from the ECU 62, the plate 104 is periodically held to its seating surface to modulate the degree of vacuum communicated to the idle air bypass valve 22. This modulation controls the amount of air which is permitted to bypass the throttle plate during idle conditions. The purpose of the other check valve 68 can be seen from the above in that with pressures in the pressure chamber 92 approaching manifold vacuum such pressure must be prohibited from entering chamber 110 and actuating the EGR valve 40.

During off-idle vehicle operating conditions characterized with the throttle being moved as illustrated in FIG. 2 by the dotted lines, manifold vacuum is communicated to the EGR valve 40 and atmospheric pressure is communicated to the idle air bypass valve 22 thus inhibiting its operation during this off-idle condition. The vacuum communicated to the input port 42 of the EGR valve 40 is varied by control signals received by the EVR valve 60 in a manner similar to that described above for controlling the operation of the idle air bypass valve 22. In this off-idle condition the function of the check valves 68 and 70 is such that check valve 70 prohibits the communication of vacuum pressure to the idle air bypass valve 22 thus maintaining it inoperative.

Many changes and modifications in the above-described embodiment of the invention can, of course, be carried out without departing from the scope thereof. Accordingly that scope is intended to be limited only by the scope of the appended claims.

What is claimed is:

1. In a system including a throttle body communicating intake air to an intake manifold of an engine, the throttle body including a movable throttle plate, a first vacuum responsive valve, and a second vacuum responsive valve;

means responsive to the position of said throttle plate for communicating vacuum manifold pressure to one of either of said first or said second vacuum responsive valves and for communicating atmospheric pressure to the other of said first or second vacuum responsive valves; and means communicated to a vacuum input port on each of said vacuum responsive valves for varying the degree of manifold vacuum communicated thereto including:

an electric vacuum regulator (EVR) including a plurality of pressure ports and a plurality of check valves, wherein one of said check valves communicates one pressure port of said EVR valve with said vacuum input port of said first vacuum responsive valve and wherein another of said check valves communicates a second pressure port of said EVR valve with said vacuum input port of said second vacuum responsive valve, first and second ports within the intake manifold and positioned relative to the throttle plate such that when said throttle plate is in a first condition said first port is communicated to manifold vacuum and said second port is communicated to atmospheric pressure, and when said throttle plate is moved to a second condition the communication of said first and second ports is reversed; and a plurality of flow restrictors, one associated with each of said first port and said second port, for communicating said first and said second port with a particular vacuum input port associated with a corresponding one of said vacuum responsive valves.

2. The system as defined in claim 1 wherein said check valves permit flow thereacross when the pressure in said pressure chamber of said EVR valve is greater than the pressure communicated to the side of said check valve communicated to said throttle body.

3. The system as defined in claim 2 wherein said electric vacuum regulator EVR valve further comprises:

a housing defining a pressure chamber, said housing including said plurality of pressure ports communicated to said pressure chamber and adapted to receive pressure signals generated by said communicating means; and a vent port for communicating air at atmospheric pressure to said pressure chamber;

said pressure chamber including a seating surface surrounding an end of said vent port; the EVR valve further including:

a magnetically responsive, movable plate adapted to seat upon said seating surface for isolating said vent port from said pressure chamber and for modulating the amount of pressure within said pressure chamber in response to control signals;

means for generating a magnetic force; and a spring for biasing said plate toward said seating surface.

4. The system as defined in claim 3 wherein said magnetic force is generated in response to a variable duty cycle electric signal.

5. In a system including a passage communicating intake air to an intake manifold of an engine, the passage including a movable throttle plate, a vacuum responsive idle speed bypass valve for bypassing intake air around the throttle plate and into the intake manifold, a vacuum responsive EGR valve for regulating the amount of exhaust gas permitted to be recirculated into the intake manifold, the improvement comprising:

means responsive to the position of said throttle plate for communicating vacuum manifold pressure to one of either of said EGR valve or said idle speed control valve and for communicating atmospheric pressure to the other of said EGR valve or said idle speed bypass valve; and means communicating to a vacuum input port on each of said idle speed bypass valve and said EGR valve for varying the degree of manifold vacuum communicating thereto and wherein said communicating means comprises:

first and second ports within the passage and positioned relative to the throttle plate such that when said throttle plate is in a first condition said first port is communicated to manifold vacuum and said second port is communicated to atmospheric pressure, and when said throttle plate is moved to a second condition the communication of said first and second ports is reversed and wherein said varying means comprises an electromagnetic vacuum regulator (EVR) valve including a plurality of pressure ports, a plurality of check valves, wherein one of said check valves communicates one pressure port of said EVR valve with said input port of said idle speed bypass valve and wherein another of said check valves communicates a second pressure port of said EVR valve with a vacuum input port of said EGR valve.

6. The system as defined in claim 5 wherein said EVR valve is operable in response to a variable duty cycle electric signal.

7. The system as defined in claim 5 wherein said check valves permit flow thereacross when the pressure in said pressure chamber of said EVR valve is greater than the pressure communicated to the side of said check valve communicated to said throttle body.

8. The system as defined in claim 7 wherein said idle speed control valve includes means for providing a nominal air flow therethrough in the absence of vacuum pressure applied thereto.

9. The system as defined in claim 8 wherein said idle speed control valve further includes means for increasing the air flow above the nominal flow and for varying the air flow therethrough as a function of the displacement of a reciprocating pin.

10. The system as defined in claim 9 wherein said nominal air flow means includes means for limiting the axial displacement of a reciprocating pin.

11. The system as defined in claim 9 wherein said nominal air flow means further includes means for establishing a nominal radial clearance between said reciprocating pin and an air flow passage through which said reciprocating pin reciprocates.

* * * * *